United States Patent [19]

Hoeptner, III

[11] Patent Number: 4,953,519

[45] Date of Patent: Sep. 4, 1990

[54] DUAL CONTACT IGNITION SYSTEM FOR MOTOCYCLE INTERNAL COMBUSTION ENGINE

[75] Inventor: Herbert W. Hoeptner, III, Morgan Hill, Calif.

[73] Assignee: Custom Chrome, Inc., Morgan Hill, Calif.

[21] Appl. No.: 391,031

[22] Filed: Aug. 9, 1989

[51] Int. Cl.[5] ..... F02P 15/02

[52] U.S. Cl. ..... 123/622; 123/146.5 A; 123/638; 123/640

[58] Field of Search ..... 123/638, 146.5 A, 622, 123/640

[56] References Cited

U.S. PATENT DOCUMENTS

| | | | |
|---|---|---|---|
| 2,025,203 | 3/1933 | Harper | 123/638 |
| 2,465,080 | 3/1949 | Fitzsimmons | 123/638 |
| 3,910,247 | 10/1975 | Hartig | 123/643 |
| 3,919,994 | 11/1975 | Munden | 123/640 |
| 4,058,691 | 11/1977 | Wittner | 123/146.5 A |
| 4,064,858 | 12/1977 | Forde | 123/146.5 A |
| 4,072,891 | 2/1978 | Campbell | 123/146.5 A |

*Primary Examiner*—Tony M. Argenbright
*Assistant Examiner*—Robert E. Mates
*Attorney, Agent, or Firm*—William W. Heafliger

[57] ABSTRACT

An ignition system for a motorcyle two cylinder internal combustion engine includes magnetically coupled primary and secondary coils, spark plugs at the cylinders, a source of electrical current, and first and second pairs of contacts respectively controlling electrical current flow to the primary coil for producing high voltage output from the secondary coil to be delivered to the spark plugs; the system includes a rotary cam driven by the engine for controlling opening of the contacts, the cam rotatable about a first axis; first and second carriers respectively carrying the first and second contacts, and adjustably rotatable about that axis; and non-rotary support structure to which the carriers may be connected, in adjusted positions of the first and second contacts about the first axis; whereby the timing of spark effected ignitions by the spark plugs may be controlled.

19 Claims, 2 Drawing Sheets

DUAL CONTACT IGNITION SYSTEM FOR MOTOCYCLE INTERNAL COMBUSTION ENGINE

BACKGROUND OF THE INVENTION

This invention relates generally to motorcycle engine ignition systems, and, more particularly, to the provision of supplemental contacts in such system to effect elimination of so-called "dead spark problems".

In conventional dual cylinder motorcycle ignition system, a single set of contact points is employed to fire both cylinders (i.e., produce spark plug ignition of combustible mixtures in each cylinder). Spark plugs at both cylinders are fired together, but only one such firing is effective—the one associated with the cylinder wherein the combustible mixture is compressed by the piston, near piston TDC (top dead center position); the other simultaneous firing is ineffective since that cylinder is at its exhaust mode of operation. This has led to problems with ignition timing, since, if the one set of points was adjustably set for optimum timing for ignition at one cylinder, it was not necessarily then correctly set for optimum timing for ignition at the other cylinder, due to differences in physical characteristics of the two cylinders and in combustible mixture flow to the two cylinders. Engine roughness resulted. Also, in the past, timing adjustment was difficult, requiring one person to control a strobe light, and another person to make the adjustment.

There is need for improvements in contact induced ignition at the spark plugs of two-cylinder, motorcycle engines of the above type.

SUMMARY OF THE INVENTION

It is a major object of the invention to provide an improved motorcycle engine ignition system that meets the above need, and there is also need for such an ignition system characterized by low cost, high efficiency, and reliability. Basically, the improved system of the present invention includes magnetically coupled primary and secondary coil means, spark plugs at the cylinders, a source of electrical current, and first and second pairs of contacts respectively controlling electrical current flow to the primary coil means for producing high voltage outputs from the secondary coil means to be delivered to the spark plugs. In that system the combination of the invention includes:

(a) rotary cam means driven by the engine for controlling opening of the contacts, the cam means rotatable about a first axis, (b) first and second carrier means respectively carrying the first and second contacts, and adjustably rotatable about said axis, (c) and non-rotary support means to which said carrier means may be connected, in adjusted positions of the first and second contacts, (d) whereby the timing of spark effected ignitions by the spark plugs may be controlled to eliminate engine roughness.

As will be seen, the secondary coil means typically includes secondary coil means A operatively connected via the primary coil means with one of said contacts and one of the spark plugs, and secondary coil means B connected via the primary coil means with the other of said contacts and the other of said spark plugs; and also the secondary coil means A may be operatively connected with both of the contacts, and said secondary coil means B also operatively connected with both of the contacts.

It is another object to provide for operative connection of secondary coil means with both pairs of contacts via primary coil means, and to be operatively connected with all the plugs, whereby all plugs fire when either of the pairs of contacts is opened or displaced.

As will be seen, the spark plugs employed in the system may include one or two plugs at each cylinder; and the plug or plugs at one cylinder may be connected with secondary coil means A, while the plug or plugs at the second cylinder may be connected with secondary coil means B. Further, the primary coil means may include primary coil means A' magnetically coupled to the secondary coil means A, and primary coil means B' magnetically coupled to the secondary coil means B. The coil means A and A' may be directly interconnected electrically, as may the coil means B and B'.

These and other objects and advantages of the invention, as well as the details of an illustrative embodiment, will be more fully understood from the following specification and drawings, in which:

DRAWING DESCRIPTION

Figure 3:
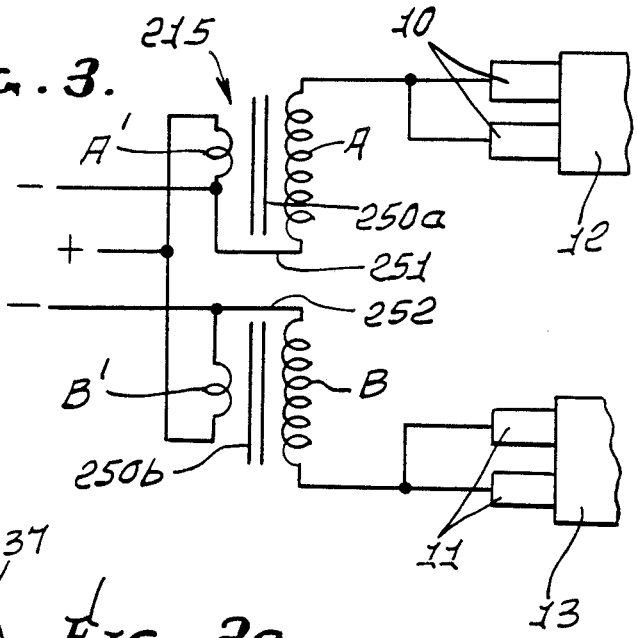
Figure 2A:
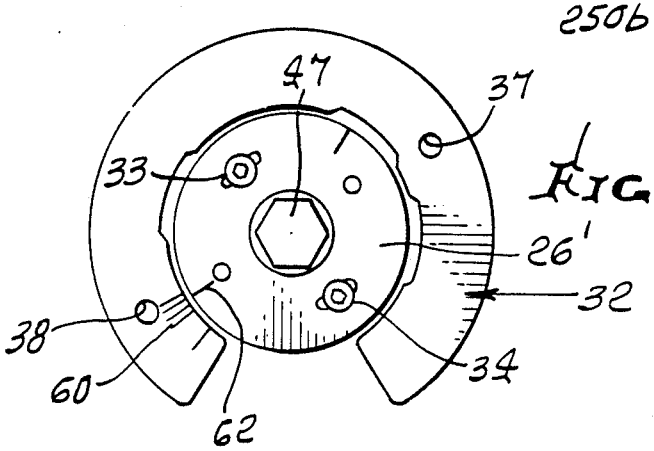
FIG. 2 is an exploded view of ignition system components.

FIG. 2*a* is an end view showing adjustment of contact unit carrier structure; and FIGS. 3 is a further ignition circuit diagram.

DETAILED DESCRIPTION

Figure 1:
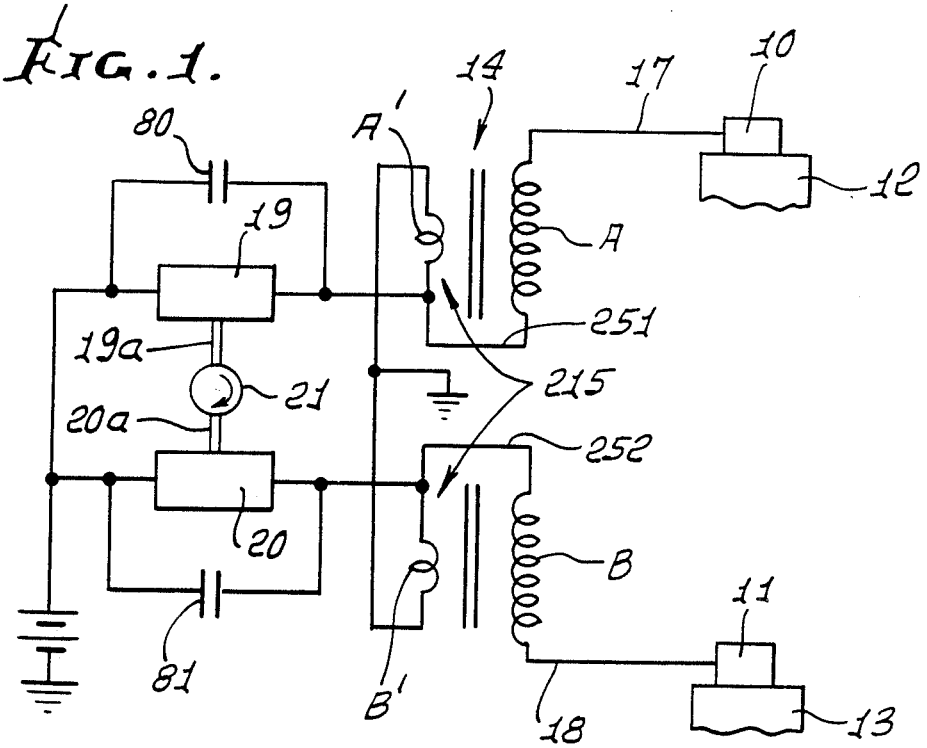
FIG. 1 is a diagrammatic view of an ignition system embodying the invention.
Figure 2:
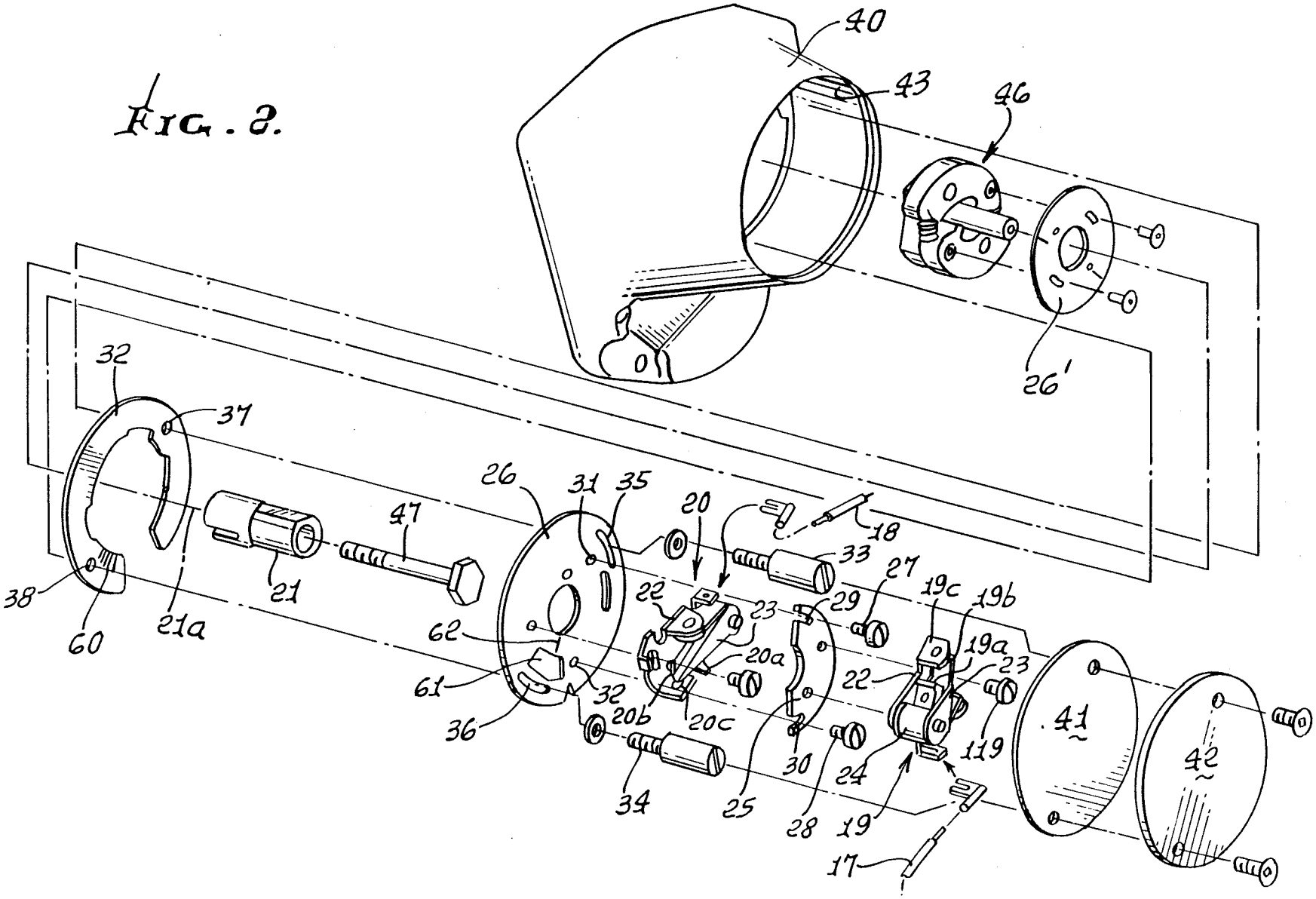

In FIGS. 1 and 2, spark plugs 10 and 11 are located respectively at two-cylinder, motorcycle engine cylinders 12 and 13. Magnetically coupled primary and secondary coil means 14 includes lower voltage primary coil means A' and B', and higher voltage secondary coil means A and B shown connected at 17 and 18 with the spark plugs. First and secondary pairs of contact units are provided at 19 and 20 for controlling electrical current flow to the primary coil means A' and B', for producing high voltage outputs from the secondary coil means to be delivered to the plugs.

As seen in FIG. 2, the assembly also includes single lobe rotary cam means, such as camshaft 21, driven, i.e., rotated, by the engine for controlling timed opening of the contacts. The camshaft is rotated about axis 21*a* so that it alternately engages the follower fingers 19*a* and 20*a* on the contact units 19 and 20, respectively. Contact points are shown as at 19*b* and 19*c*, and 20*b* and 20*c*, to be opened and closed in response to camshaft rotation. The units 19 and 20 each include, in addition, two pivotally connected arms 22 and 23, and a coil spring 24 tending to close the arms toward one another, the cam and follower interengagement tending to deflect an arm to open the points at the optimum time during the engine piston stroke to fire the compressed combustible charge in the cylinder.

For timing purposes, first and second carrier means are provided, respectively carrying the contact units, each being adjustably rotatable about axis 21*a* to an adjusted position.

The first carrier means is referenced in FIGS. 2 at 25, and the second carrier means at 26, these being thin plates which may be insulative. Plate 25 is semi-annular and attached to plate 26, as via fasteners 27 and 28 passing through sector shaped slots 29 and 30 in plate 25 and into threaded openings 31 and 32 in plate 26. Thus, plate 25, carrying contact unit 19, as via fastener or fasteners 119, is adjustably rotatable relative to plate 26, and relative to a non-rotatable support plate 32. Plate 26 is in turn adjustably rotatable on, and retained on, plate 32, as by threaded fasteners 33 and 34, passing through sector shaped openings or slots 35 and 36 in plate 26, and into threaded openings 37 and 38 in plate 32. The latter is suitably carried by a housing or body 40. A gasket 41 and cover plate 42 cover and close the opening 43 in the housing via which the described elements are assembled into the housing, and via which they are easily accessible for adjustment and replacement.

Unit 46 carries the camshaft, as via a fastener 47, and adjustably rotates the camshaft for spark advance purposes, as is known. The engine drives unit 46.

In FIGS. 2 and 2*a*, indicia 60 on the support unit 32 are visible through a window 61 in plate 26; and a marker 62 on plate 26' is rotatably adjustable relative to such indicia, for timing purposes. Plate 25 may be similarly adjusted on plate 26; and all such adjustments can be easily carried out by removing the cover and gasket, viewing the indicia and marker, loosening the fasteners 27, 28, 33, and 34, adjustably rotating the plates 25 and 26, and then tightening the fasteners.

In FIG. 3, the arrangement is like FIG. 1, except that two spark plugs 10 are connected with A, and associated with cylinder 12; and two spark plugs 11 are connected with B, and associated with cylinder 13. The primary coil 215 is coupled via cores 250*a* and 250*b* to secondary coils A and B, as shown. Coil 215 embodies section A' and section B'. Section A' is also electrically connected at 251 to secondary coil A; and section B' is also electrically connected at 252 to secondary coil B.

In FIG. 1, capacitors 80 and 81 are connected across the contact points, as shown.

In the above, the following equivalent nomenclature is stated:

"secondary coil means A" is equivalent to, "first secondary coil means"

"secondary coil means B" is equivalent to, "second secondary coil means"

primary coil means A'" is equivalent to, "first primary coil means"

"primary coil means B" is equivalent to, "second primary coil means".

I claim:

1. In an ignition system for a motorcycle two cylinder internal combustion engine, the system including magnetically coupled primary and secondary coil means, spark plugs at the cylinders, a source of electrical current, and first and second pairs of contacts respectively controlling electrical current flow to the primary coil means for producing high voltage outputs from the secondary coil means to be delivered to the spark plugs, the combination comprising (a) rotary cam means driven by the engine for controlling opening of the pairs of contacts, the cam means rotatable about a first axis, (b) first and second carrier means respectively carrying the first and second pairs of contacts, and each adjustably rotatable about said axis, one of said first and second carrier means operatively connected to the other of said first and second carrier means for adjustment relative thereto, (c) and non-rotary support means to which said carrier means is connected, in adjusted positions of the first and second pairs of contacts, (d) whereby the timing of spark effected ignitions by the spark plugs may be controlled.

2. The combination of claim 1 wherein said secondary coil means includes first secondary coil means operatively connected via the primary coil means with one of said pair of contacts and one of the spark plugs, and second secondary coil means connected via the primary coil means with the other of said pair of contacts and the other of said spark plugs, said first secondary coil means being separate from said second secondary coil means.

3. The combination of claim 2 wherein said spark plugs include:

a single plug at one cylinder and connected with said first secondary coil means a single plug at the second cylinder and connected with said second secondary coil means.

4. The combination of claim 2 wherein said spark plugs include:

two plugs at one cylinder and connected with said first secondary coil means two plugs at the second cylinder and connected with said second secondary coil means.

5. The combination of claim 2 wherein said primary coil means includes first primary coil means magnetically coupled to said first secondary coil means, and second primary coil means magnetically coupled to said second secondary coil means said first primary coil means being separate from said second primary coil means.

6. The combination of claim 5 wherein said first primary coil means is also connected with said first secondary coil means, and said second primary coil means is also connected with second secondary coil means.

7. The combination of claim 6 wherein said spark plugs include:

a single plug at one cylinder and connected with said first secondary coil means a single plug at the second cylinder and connected with said second secondary coil means.

8. The combination of claim 6 wherein said spark plugs include:

two plugs at one cylinder and connected with said first secondary coil means two plugs at the second cylinder and connected with said second secondary coil means.

9. In an ignition system for a motorcycle two cylinder internal combustion engine, the system including magnetically coupled primary and secondary coil means, spark plugs at the cylinders, a source of electrical current, and first and second pairs of contacts respectively controlling electrical current flow to the primary coil means for producing high voltage outputs from the secondary coil means to be delivered to the spark plugs, the combination comprising (a) rotary cam means driven by the engine for controlling opening of the pairs of contacts, the cam means rotatable about a first axis, (b) first and second carrier means respectively carrying the first and second pairs of contacts, and each adjustably rotatable about said axis, (c) and non-rotary support means to which said carrier means is connected, in adjusted positions of the first and second pairs of contacts, (d) whereby the timing of spark effected ignitions by the spark plugs may be controlled, (e) said first carrier means being adjustably carried by the second carrier means.

10. The combination of claim 9 wherein said second carrier means is adjustably carried by said non-rotary support means.

11. The combination of claim 1 wherein said cam means has a single lobe for operating both pairs of contacts.

12. In an ignition system for a motorcycle two cylinder internal combustion engine, the system including magnetically coupled primary and secondary coil means, spark plugs at the cylinders, a source of electrical current, and first and second pairs of contacts respectively controlling electrical current flow to the primary coil means for producing high voltage outputs from the secondary coil means to be delivered to the spark plugs, there being carrier plate means carrying said first and second pairs of contacts for effecting relative rotary adjustment of the first and second pairs of contacts relative to each other in response to axially effected adjustment from the same axial direction, said second coil means including one secondary coil means operatively connected via the primary coil means with one pair of contacts and one of the spark plugs, and another secondary coil means connected via the primary coil means with another pair of contacts and the other of said spark plugs.

13. The combination of claim 12 wherein said spark plugs include:

a single plug at one cylinder and connected with said one secondary coil means a single plug at the second cylinder and connected with said other secondary coil means.

14. The combination of claim 12 wherein said spark plugs include:

two plugs at one cylinder and connected with said one secondary coil means two plugs at the second cylinder and connected with said other secondary coil means.

15. The combination of claim 12 wherein said primary coil means includes one primary coil means magnetically coupled to said one secondary coil means, and another primary coil means magnetically coupled to said other secondary coil means.

16. The combination of claim 12 wherein said one primary coil means is also electrically connected with said one secondary coil means, and said other primary coil means is also electrically connected with said other secondary coil means.

17. The combination of claim 16 wherein said spark plugs include:

a single plug at one cylinder and connected with said one secondary coil means, and a single plug at the second cylinder and connected with said other secondary coil means.

18. The combination of claim 16 wherein said spark plugs include:

two plugs at one cylinder and connected with said one secondary coil means, and two plugs at the second cylinder and connected with said other secondary coil means.

19. In an ignition system for a motorcycle two cylinder internal combustion engine, the system including magnetically coupled primary and secondary coil means, spark plugs at the cylinders, a source of electrical current, and first and second pairs of contacts respectively controlling electrical current flow to the primary coil means for producing high voltage outputs from the secondary coil means to be delivered to the spark plugs, the combination comprising (a) rotary cam means driven by the engine for controlling opening of the pairs of contacts, the cam means rotatable about a first axis, (b) first and second carrier means respectively carrying the first and second pairs of contacts, and each adjustably rotatable about said axis, (c) and non-rotary support means to which said carrier means is connected, in adjusted positions of the first and second pairs of contacts, (d) whereby the timing of spark effected ignitions by the spark plugs may be controlled, (e) said carrier means comprising plates, and including adjustable fasteners and slots on the plates to adjustably attach the first plate to the second plate, and the second plate to the non-rotary support means, the fasteners located to be accessible axially endwise from the same direction.

* * * * *